US008555925B2

(12) United States Patent
Stadel et al.

(10) Patent No.: US 8,555,925 B2
(45) Date of Patent: Oct. 15, 2013

(54) PRESSURE RELIEF VALVE FOR A PACKAGING CONTAINER

(75) Inventors: Hans-Peter Stadel, Lorch (DE); Herbert Stotkiewitz, Bietigheim-Bissingen (DE); Juergen Haak, Le Roermond (DE)

(73) Assignee: Robert Bosch GmbH, Stuttgart (DE)

( * ) Notice: Subject to any disclaimer, the term of this patent is extended or adjusted under 35 U.S.C. 154(b) by 20 days.

(21) Appl. No.: 13/148,973

(22) PCT Filed: Jan. 11, 2010

(86) PCT No.: PCT/EP2010/050211
§ 371 (c)(1),
(2), (4) Date: Nov. 7, 2011

(87) PCT Pub. No.: WO2010/091908
PCT Pub. Date: Aug. 19, 2010

(65) Prior Publication Data
US 2012/0048853 A1 Mar. 1, 2012

(30) Foreign Application Priority Data
Feb. 12, 2009 (DE) ..... 10 2009 000 802

(51) Int. Cl.
*F16K 15/14* (2006.01)

(52) U.S. Cl.
USPC ..... 137/843; 137/851; 137/246; 383/100

(58) Field of Classification Search
USPC ..... 137/843, 851, 246; 383/100
See application file for complete search history.

(56) References Cited

U.S. PATENT DOCUMENTS

| | | | | |
|---|---|---|---|---|
| 5,263,777 | A | 11/1993 | Domke | |
| 5,992,442 | A | 11/1999 | Urquhart et al. | |
| 7,721,752 | B2 | 5/2010 | Stotkiewitz et al. | |
| 7,967,022 | B2 * | 6/2011 | Grant et al. | 137/100 |
| 2006/0144452 | A1 | 7/2006 | Stotkiewitz et al. | |
| 2007/0204918 | A1 | 9/2007 | Weaver et al. | |
| 2008/0011751 | A1 * | 1/2008 | Stotkiewitz et al. | 220/203.1 |

FOREIGN PATENT DOCUMENTS

| | | | |
|---|---|---|---|
| DE | 19843430 | A1 | 3/2000 |
| GB | 1040375 | | 8/1966 |
| WO | 2005/036983 | A2 | 4/2005 |
| WO | 2008/072041 | A1 | 6/2008 |

OTHER PUBLICATIONS

PCT/EP2010/050211 International Search Report, Mar. 31, 2010.

* cited by examiner

*Primary Examiner* — Kevin Lee
*Assistant Examiner* — Macade Brown
(74) *Attorney, Agent, or Firm* — Michael Best & Friedrich LLP

(57) ABSTRACT

The invention relates to a pressure relief valve for a packaging container (3), comprising a base body (4) with a central through opening (9), a sealing surface (14) and a peripheral region (18), wherein the peripheral region (18) may be sealingly connected to an inner side (3*a*) of the packaging container (3) and the sealing surface (14) has an inwardly tapering form and a membrane (6), making contact with the sealing surface (14) to permit a seal wherein a fluid (5) is arranged between the sealing surface (14) and the membrane (6). The membrane (6) is flexible and a recess (30) is made in the base body (4) into which the central through opening (9) opens out, wherein in the opening region of the central through opening (9), an annular bead (12) projecting in the direction of the membrane (6) is arranged, projecting into the recess (30).

20 Claims, 2 Drawing Sheets

PRESSURE RELIEF VALVE FOR A PACKAGING CONTAINER

BACKGROUND OF THE INVENTION

The present invention relates to a pressure relief valve for a packaging container with significantly improved sealing properties.

Various embodiments of pressure relief valves for packaging containers are known from the prior art. The use of valves, especially on flexible packages for foodstuffs, has already been implemented by a large number of technical variants. A principal requirement on valves of this kind is that they should permit only slight excess pressures in the package through appropriate opening and otherwise should reliably prevent the penetration of ambient air. In this context, the penetration of ambient air must be prevented even when the pressure in the package is very low. In practice, however, the two above-mentioned aims are in conflict since, on the one hand, the pressure for opening the valve should only be low and, on the other hand, high vacuum tightness should be provided. Valves which have a high vacuum tightness therefore also have a very high opening pressure. In contrast, valves with only a low opening pressure do not have the necessary vacuum tightness.

EP 1 802 537 B1 has disclosed a pressure relief valve which is designed to be uneven in part in a recess in a main body. This results in differences in the distance between the recess and a valve diaphragm in different zones. This valve has fundamentally proven its worth but very recently there have been an increasing number of uses which require an improved opening characteristic and vacuum tightness.

SUMMARY OF THE INVENTION

In contrast, the pressure relief valve according to the invention for a packaging container has the advantage that it consists of a minimum number of parts and is constructed in a simple and economical manner. Moreover, the pressure relief valve according to the invention has high vacuum resistance (tightness), on the one hand, and, on the other hand, allows opening even with small pressure differences between a pressure in the interior of the packaging container and an outer side in order to release this pressure to the outside. According to the invention, this is achieved by virtue of the fact that the pressure relief valve has a main body with an inward-tapering sealing surface and a diaphragm which rests on the sealing surface in order to seal off a central through opening. On the side of the through opening oriented toward the diaphragm, said opening has an annular bead projecting from a recess in the main body. According to the invention, this ensures that, when the vacuum in the packaging container is very high, the diaphragm rests not only against the sealing surface of the main body but also against the annular bead around the through opening and thus provides very reliable sealing of the vacuum in the packaging container. A fluid is furthermore provided between the diaphragm and the tapering sealing surface, the inward-tapering form of the sealing surface ensuring that the thickness of the layer of fluid between the sealing surface and the diaphragm is somewhat greater on an inner side than on an outer side. As a result, larger capillary retaining forces are provided on the outer side, ensuring more secure seating of the diaphragm on the sealing surface. On the one hand, this ensures leaktightness relative to a high vacuum in the packaging container by virtue of the relatively high forces on the outer side of the sealing surface and, on the other hand, permits easier opening by virtue of the somewhat lower forces on the inner area of the sealing surface, with the opening forces during the opening process increasing continuously owing to the continuously increasing diaphragm surface area exposed to the excess pressure in the packaging container, thus ensuring more rapid opening.

The central through opening in the main body is preferably of tapering design. This makes it possible to influence the flow behavior of gases released to the outside from the packaging container. As a particularly preferred option here, the central through opening tapers in the direction of the interior space. This makes it possible to obtain a diffuser effect as gas flows out of the interior of the packaging container, thus providing more rapid opening and/or opening even with only very small pressure differences in a range of less than 500 Pa. The central through opening is preferably of conical design.

More preferably, a level of the annular bead relative to the inner side of the packaging container is below a level of an inner edge of the sealing surface of the main body. Here, the word "level" is intended to mean a plane perpendicular to a center line of the main body, said level being defined from a side of the pressure relief valve which is oriented toward the inside of the packaging container.

More preferably, the diaphragm has a deformable surface oriented toward the sealing surface in addition to the flexible properties. Even better vacuum resistance is thereby achieved since a deformation of the surface of the diaphragm takes place at the sealing surface during the sealing process, leading to reduced thicknesses of fluid between the diaphragm and the sealing surface.

According to another preferred embodiment of the invention, the pressure relief valve furthermore comprises an annular retaining device, which is formed integrally with the main body. This retaining device prevents the diaphragm coming away from the main body in an unforeseen manner.

More preferably, the central recess in the main body is formed in two stages with a base recess and a stepped region, which lies at a somewhat higher level. In this arrangement, an outer contour of the base recess is formed in such a way that it corresponds to an outer contour of an eight. In other words, the outer contour of the base recess describes the shape of two intersecting circles, it being possible for said circles to have the same radii or different radii.

The deformable surface of the diaphragm is preferably made of EPDM or NBR or silicone rubber. As an alternative, it is also possible for the entire diaphragm to be produced from one of these materials. These materials ensure the necessary flexibility of the diaphragm and the same or deformable surface while contributes to the improved sealing properties.

According to another preferred embodiment of the invention, the through opening has a bottom region with a perforation made therein. As an alternative, a filter element is arranged on the through opening. Both the perforation and the filter element have the filtering function in order to prevent the possibility of small particles accidentally entering the pressure relief valve.

The peripheral region of the main body, said region being used to fix the pressure relief valve to the inner side of the packaging container, is preferably designed in such a way that the peripheral region has an inner ring, an outer ring and a central ring, the central ring projecting further from a base surface than the inner ring and the outer ring. It is thereby possible, especially during an ultrasonic sealing operation, to ensure that any particles formed do not fall into the interior of the pressure relief valve or toward the outside during the sealing operation but are collected between the central ring and the outer ring or the inner ring.

The pressure relief valve according to the invention is preferably used on food packaging, especially that for powdered goods, e.g. coffee.

BRIEF DESCRIPTION OF THE DRAWINGS

A preferred illustrative embodiment of the invention is described in detail below with reference to the accompanying drawing, in which.

DETAILED DESCRIPTION

A pressure relief valve 1 in accordance with a preferred illustrative embodiment of the invention is described in detail below with reference to FIGS. 1 to 4.

Figure 1:
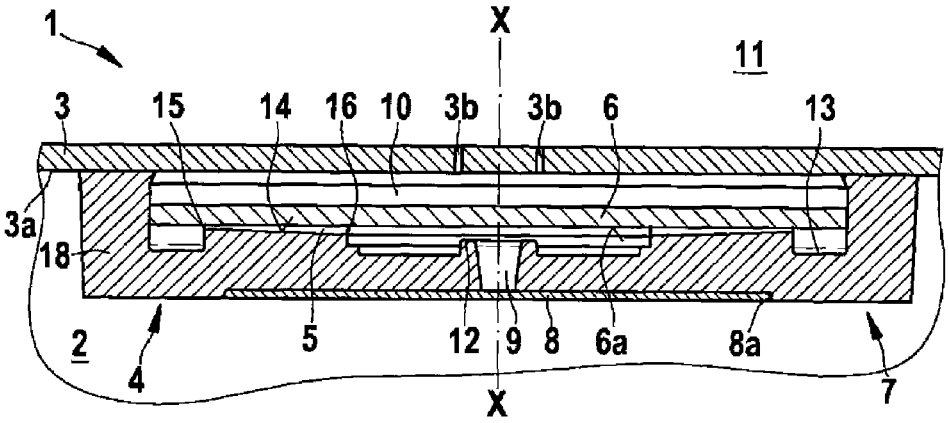
FIG. 1 is a schematic sectional view of a pressure relief valve in accordance with one illustrative embodiment of the invention.
Figure 2:
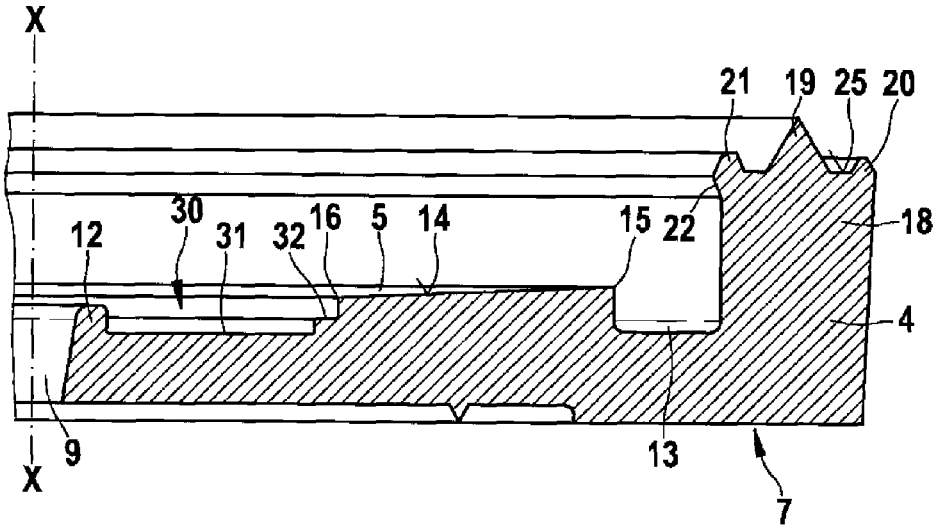
FIG. 2 is a schematic sectional view, on an enlarged scale, of the main body of the pressure relief valve, said body being shown in FIG. 1.

As can be seen from FIG. 1, the pressure relief valve 1 comprises a main body 4 and a diaphragm 6. The main body 4 has a sealing surface 14, which tapers conically inward in the direction of a center line X-X. A fluid 5 is arranged between the sealing surface 14 and the diaphragm 6 and forms a thin layer of fluid. This layer of fluid becomes continuously somewhat thicker from an outer edge 15 of the sealing surface 14 to an inner edge 16.

A filter element 8 is provided in a small recess 8*a* on a side 7 of the main body 4 which is oriented toward the inner side of a package in the assembled condition. More particularly, the filter element 8 covers a central through opening 9 and prevents small particles from being able to flow into the through opening 9 and thus into the pressure relief valve 1.

The pressure relief valve 1 is arranged on an inner side 3*a* of the package 3. A plurality of outlet openings 3*b*, the inner opening region of which is covered by the pressure relief valve 1 from the inner side 3*a*, are furthermore arranged in the package 3. On the one hand, the pressure relief valve 1 ensures that no gas or no fluid can enter an interior space 2 of the package 3 from an outer side 11, and furthermore ensures that, when there is an excess pressure in the interior of the package 3, said pressure can be released to the outside via the pressure relief valve 1.

In addition to the sealing surface 14, the main body 4 has a central recess 30. The central recess 30 comprises a base recess 31, which forms a bottom surface of the central recess 30, and a stepped region 32, which is arranged radially to the outside of the base recess 31. In this arrangement, a level of the base recess 31 is lower than a level of the stepped region 32. It should be noted that the term "level" is intended to refer to a plane perpendicular to the center line X-X, where defining a level as lower means that said level is closer to that side 7 of the pressure relief valve 1 which is oriented toward the inside in the package.

The central through opening 9 is also arranged in the central recess 30 and, as can be seen especially from FIG. 1, the central recess 30 widens conically outward, i.e. in the direction of the diaphragm 6. An annular bead 12 projecting from the base recess 31 is provided in the opening region of the central recess 30. A level of the annular bead 12 is above a level of the stepped region 32 but below a level in which the encircling inner edge 16 is situated (cf. FIG. 2).

An encircling outer annular groove 13 is furthermore provided radially to the outside of the sealing surface 14. A peripheral region 18, by means of which the pressure relief valve 1 is fixed on the inner side 3*a* of the package 3, is furthermore arranged adjacent to the outer annular groove 13. This fixing is preferably accomplished by means of an ultrasonic sealing method. As can be seen from FIG. 2, the peripheral region 18 has a central ring 19, an outer ring 20 and an inner ring 21. The central ring 19 projects further relative to a base surface 25 than the outer ring 20 and the inner ring 21. The base surface 25 thus forms recesses between the inner ring 21 and the central ring 19 and between the central ring 19 and the outer ring 20. Any particles produced during the fixing process can be collected in these recesses, thus making it possible to prevent said particles from falling into an inner area of the pressure relief valve 1. As can furthermore be seen from FIG. 2, an encircling retaining ring 22, which projects radially inward, is formed on a radial inner side of the inner ring 21. The retaining ring 22 is likewise formed integrally with the main body 4 and prevents the diaphragm 6 coming away accidentally from the main body 4. The retaining ring 22 thus serves to hold down the diaphragm 6.

The diaphragm 6 is produced from a flexible material and has a soft and deformable surface 6*a*. This soft and deformable surface 6*a* is the surface of the diaphragm 6 which is oriented in the direction of the sealing surface 14 of the main body 4.

Figure 3:
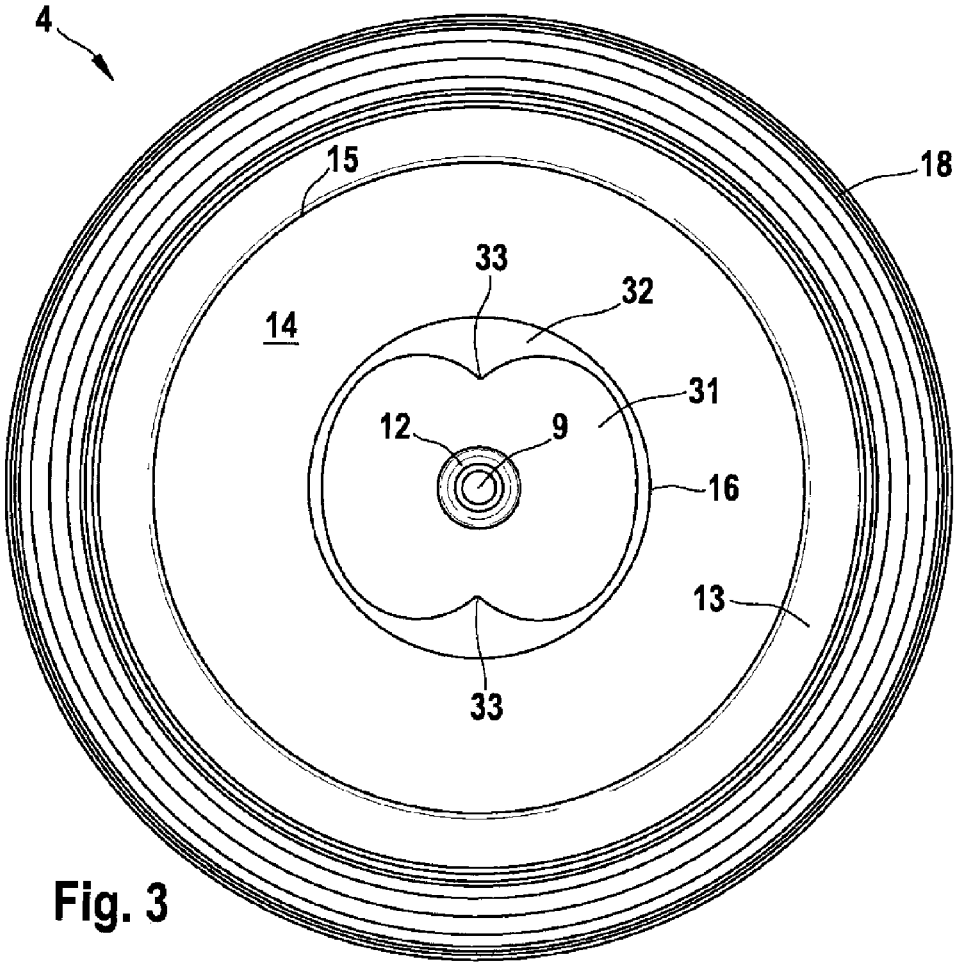
FIG. 3 is a schematic plan view of the main body.
Figure 4:
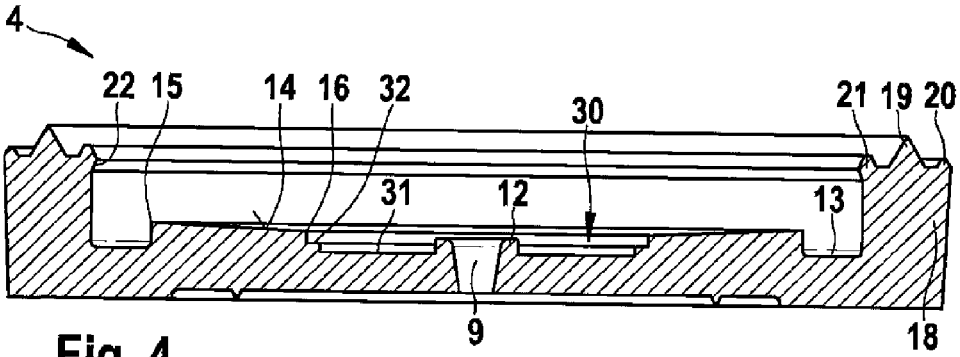
FIG. 4 is a schematic sectional view of the main body.

As can furthermore be seen from FIG. 3, an outer contour of the base recess 31 is formed in such a way that said outer contour corresponds substantially to an outer contour of an eight. Here, the central through opening 9 is arranged centrally. Designing the outer contour of the base recess 31 in the form of an eight in this way provides improved flow behavior when there is a release of gas from the interior 2 of the packaging container 3 to the outer side 11. The constricted regions 33 of the outer contour allow directional outflow from the central through opening 9, enabling an opening process of the diaphragm to be assisted. This ensures that the pressure relief valve 1 can open at even smaller pressure differences between the interior 2 and the outer side 11.

The pressure relief valve 1 according to the invention operates as follows. If there is a strong vacuum in the interior 2 of the packaging container 3, the pressure relief valve 1 must allow reliable sealing relative to the outer side 11. The strong vacuum deforms the flexible diaphragm 6, causing it to rest sealingly on the sealing surface 14 of the main body 4. Given an appropriately high vacuum, the deformation can furthermore be such that the diaphragm 6 also rests on the annular bead 12. Since the diaphragm 6 has a soft and deformable surface 6*a*, there is additionally a deformation in the contact areas, and the inward-tapering sealing surface of the sealing surface 14 ensures that the deformation is somewhat more pronounced at the outer edge 15 than at the inner edge 16. As a result, a thickness of a fluid 5, especially in the region of the outer edge 15, decreases to a very low level, with the result that high capillary forces and adhesion forces act here and ensure particularly high leaktightness. In this case, the fluid 5 forms a particularly thin film in the region of the outer edge 15.

If the pressure in the interior of the package 3 is above a pressure on the outer side 11, this pressure must be released via the internal pressure valve 1 and the through openings 3*b* in order, in particular, to avoid inflation of the packaging container 3. If there is an excess pressure in the interior 2, a pressure-induced force thus acts on the inner side of the diaphragm 6. If the diaphragm 6 is resting on the annular bead 12 in order to provide sealing, the pressure-induced force can thus act only via the area bounded by the inner edge of the annular bead 12. Since, however, the central through opening 9 widens conically outward, the pressure in this region rises somewhat, thus ensuring that the diaphragm 6 lifts slightly from the annular bead 12. Since the capillary or adhesive forces of the layer of fluid in the region of the inner edge 16 are furthermore somewhat lower, owing to the tapering arrangement of the sealing surface 14, the pressure relief valve can open, since the pressure can now act on a larger area of the diaphragm 6 (namely the sealing surface defined by the inner edge 16), if the resulting pressure-induced forces on the diaphragm 6 are greater than the capillary or adhesive forces which hold the diaphragm 6 on the sealing surface 14. Thus only comparatively small pressure-induced forces are required to overcome the capillary forces in the region of the inner edge 16. Owing to the flexibility of the diaphragm 6, the area of application increases further as a result, and therefore the internal excess pressure can then always act on an increasing area of the diaphragm 6, and an opening process can be carried out correspondingly more rapidly. In this context, FIG. 1 shows an opened state of the pressure relief valve 1, in which the gas can flow out of the interior via gaps between the diaphragm 6 and the peripheral region 18 into a region 10 between the diaphragm 6 and the inner side 3*a* of the packaging body and from there via the passage openings 3*b* to the outer side 11.

It is thus possible, according to the invention, to provide a pressure relief valve 1 of simple construction which consists of just two parts, namely the main body 4 and the diaphragm 6. By virtue of the arrangement according to the invention of the central through opening 9 with the corresponding annular bead 12, it is possible, on the one hand, to obtain improved opening behavior and, on the other hand, also improved vacuum tightness.

The invention claimed is:

1. A pressure relief valve for a packaging container (3), the pressure relief valve comprising:

a main body (4) with a single central through opening (9), a sealing surface (14) and a peripheral region (18), wherein the peripheral region (18) can be sealingly connected to an inner side (3*a*) of the packaging container (3) and wherein the sealing surface (14) has an inwardly tapering form, and a diaphragm (6), which rests on the sealing surface (14) to permit sealing, a fluid (5) being arranged between the sealing surface (14) and the diaphragm (6), wherein the diaphragm (6) is flexible and wherein a recess (30) is formed in the main body (4), wherein the central through opening (9) opens into the recess (30), wherein at the central through opening (9), an annular bead (12) is disposed that projects in the direction of the diaphragm (6) and projects into the recess (30), and wherein the single central opening (9) is symmetrically disposed with respect to an entire perimeter of the main body (4).

2. The pressure relief valve as claimed in claim 1, wherein the central through opening (9) tapers.

3. The pressure relief valve as claimed in claim 2, wherein the central through opening (9) tapers in the direction of a side (7) facing an interior space (2) of the container.

4. The pressure relief valve as claimed in claim 1, wherein a level of the annular bead (12) perpendicular to a center line (X-X) relative to the inner side (3*a*) of the packaging container is below a level of an inner edge (16) of the sealing surface (14) perpendicular to the center line (X-X).

5. The pressure relief valve as claimed in claim 1, wherein the diaphragm (6) has a deformable surface (6*a*) oriented toward the sealing surface (14).

6. The pressure relief valve as claimed in claim 1, further comprising an annular retaining device (22) formed integrally with the main body (4).

7. The pressure relief valve as claimed in claim 1, wherein the recess (30) is formed in two stages with a base recess (31) and a stepped region (32), an outer contour of the base recess (31) corresponding substantially to an outer contour of an eight.

8. The pressure relief valve as claimed in claim 5, wherein the diaphragm (6) has a surface made of EPDM or NBR or silicone rubber.

9. The pressure relief valve as claimed in claim 1, wherein the central through opening (9) comprises a bottom region with a perforation therein.

10. The pressure relief valve as claimed in claim 1, wherein the peripheral region (18) of the main body (4) has an inner ring (21), an outer ring (20) and a central ring (19) before a sealing operation on the packaging container (3), the central ring (19) projecting further outward from a base surface (25) than the inner ring (21) and the outer ring (20).

11. The pressure relief valve as claimed in claim 1, wherein the central through opening (9) is of conically tapering design.

12. The pressure relief valve as claimed in claim 5, wherein the diaphragm (6) is produced entirely from EPDM or NBR or silicone rubber.

13. The pressure relief valve as claimed in claim 1, wherein the central through opening (9) is covered by means of a filter element (8).

14. The pressure relief valve as claimed in claim 7, wherein the stepped region (32) is radially outside of the base recess (31).

15. The pressure relief valve as claimed in claim 7, wherein a level of the stepped region (32) is above a level of the base recess (31).

16. The pressure relief valve as claimed in claim 7, wherein a level of the annular bead (12) is above a level of the stepped region (32).

17. A pressure relief valve for a packaging container (3), the pressure relief valve comprising:

a main body (4) with a central through opening (9), a sealing surface (14) and a peripheral region (18), wherein the peripheral region (18) can be sealingly connected to an inner side (3*a*) of the packaging container (3) and wherein the sealing surface (14) has an inwardly tapering form, and a diaphragm (6), which rests on the sealing surface (14) to permit sealing, a fluid (5) being arranged between the sealing surface (14) and the diaphragm (6), wherein the diaphragm (6) is flexible and wherein a recess (30) is formed in the main body (4), wherein the central through opening (9) opens into the recess (30), wherein at the central through opening (9), an annular bead (12) is disposed that projects in the direction of the diaphragm (6) and projects into the recess (30), wherein the diaphragm (6) has a deformable surface (6*a*) oriented toward the sealing surface (14), and wherein the recess (30) includes a base recess (31) and a stepped region (32), an outer contour of the base recess (31) corresponding substantially to an outer contour of an eight.

18. The pressure relief valve as claimed in claim 17, wherein the central through opening (9) tapers.

19. The pressure relief valve as claimed in claim 18, wherein the central through opening (9) tapers in the direction of a side (7) facing an interior space (2) of the container.

20. The pressure relief valve as claimed in claim 17, wherein a level of the annular bead (12) perpendicular to a center line (X-X) relative to the inner side (3*a*) of the packaging container is below a level of an inner edge (16) of the sealing surface (14) perpendicular to the center line (X-X).

* * * * *

UNITED STATES PATENT AND TRADEMARK OFFICE

CERTIFICATE OF CORRECTION

PATENT NO. : 8,555,925 B2
APPLICATION NO. : 13/148973
DATED : October 15, 2013
INVENTOR(S) : Stadel et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 46 days.

Signed and Sealed this
Fifteenth Day of September, 2015

Michelle K. Lee

Michelle K. Lee
*Director of the United States Patent and Trademark Office*